United States Patent [19]

Gawlick et al.

[11] 3,941,058

[45] Mar. 2, 1976

[54] ELECTRIC IGNITION DEVICE

[75] Inventors: Heinz Gawlick, Furth, Bavaria; Uwe Brede, Schwaig, both of Germany

[73] Assignee: Dynamit Nobel Aktiengesellschaft, Germany

[22] Filed: Mar. 22, 1974

[21] Appl. No.: 453,801

[30] Foreign Application Priority Data

Mar. 24, 1973 Germany ..... 2314709

[52] U.S. Cl. ..... 102/70.2 GA; 102/64; 102/70.2 R

[51] Int. Cl.[2] ..... F42C 11/06

[58] Field of Search ..... 102/70.2 R, 70.2 GA, 64, 102/28, 70.2 A

[56] References Cited

UNITED STATES PATENTS

| | | | |
|---|---|---|---|
| 2,926,610 | 3/1960 | Ruehlemann | 102/70.2 R |
| 3,078,801 | 2/1963 | Rzewinski et al. | 102/70.2 R |
| 3,712,218 | 1/1973 | Fay | 102/70.2 R |

*Primary Examiner*—Samuel Feinberg
*Assistant Examiner*—C. T. Jordan
*Attorney, Agent, or Firm*—Craig & Antonelli

[57] ABSTRACT

An electric fuze, especially for hand grenades, having a power source which is activatable by the effect of a force for supplying output power and a delay unit for delaying the ignition of a primer with respect to the time of activation of the power source. The delay unit has a variable time constant and includes an RC circuit formed of a plurality of series or parallel connected resistors and/or capacitors which are functionally connected with one another by electrical leads which leads are arranged to be open-circuited for the purpose of changing the delay time in a predetermined manner.

19 Claims, 7 Drawing Figures

FIG. 1
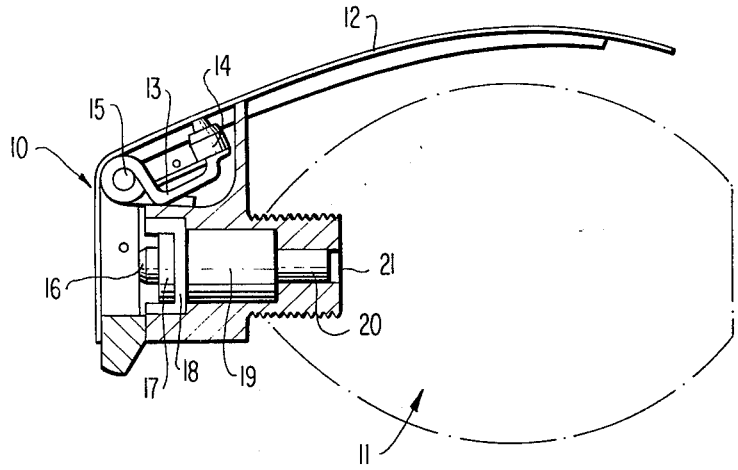
FIG. 2
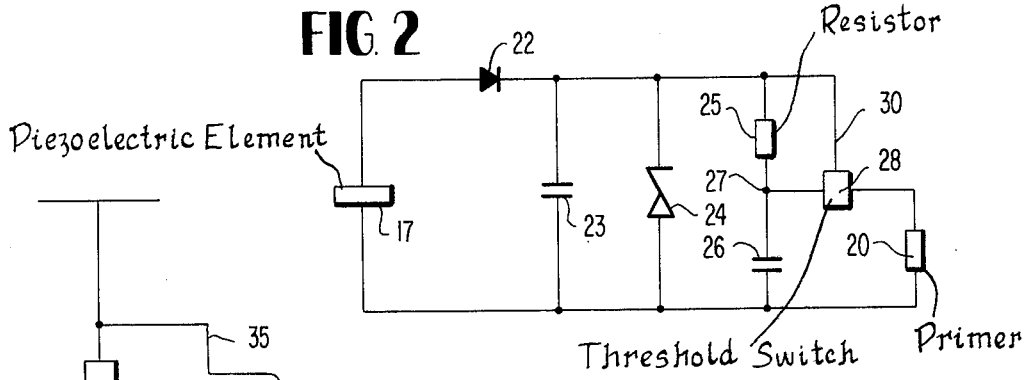
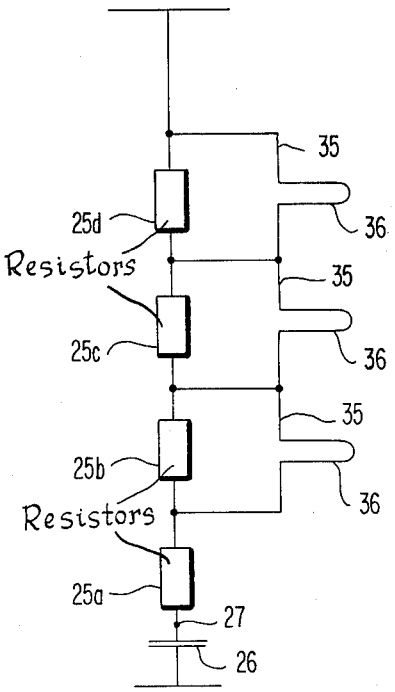
FIG. 4
FIG. 3
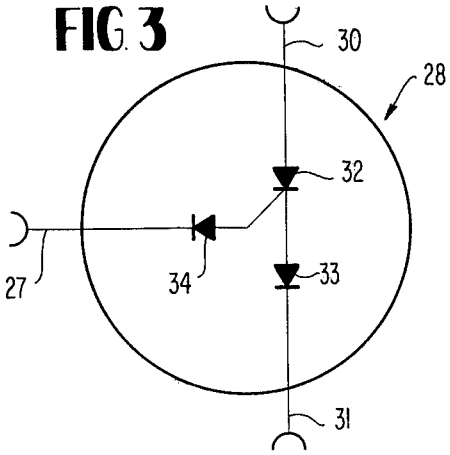

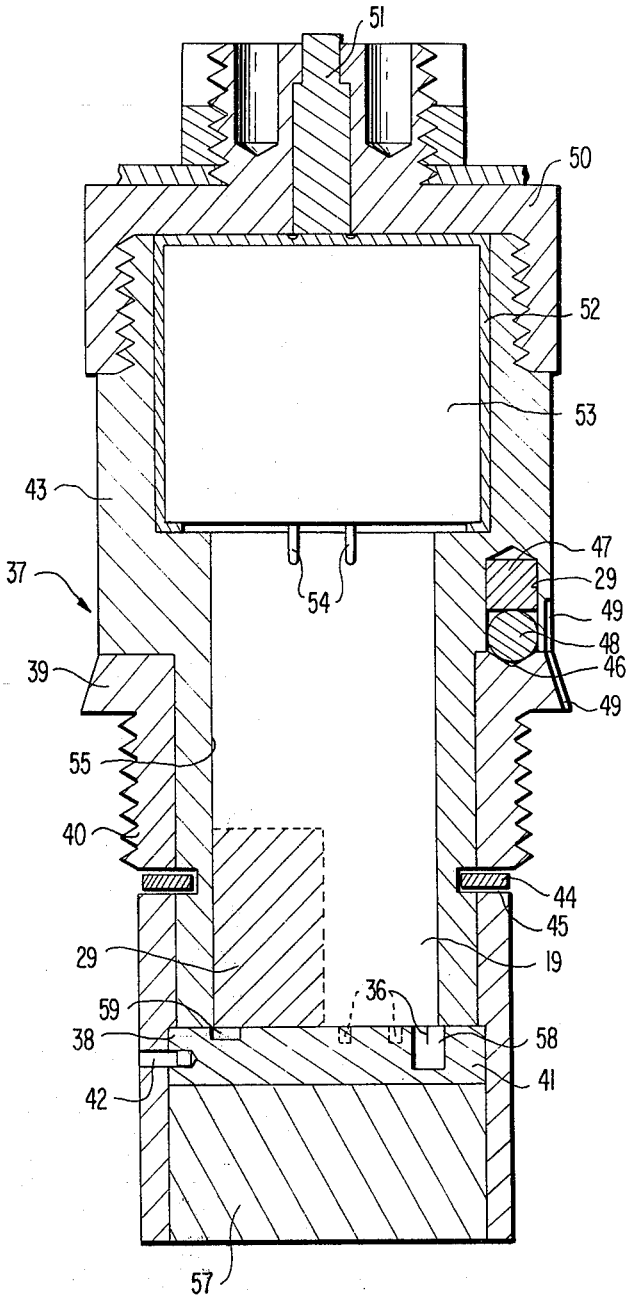
FIG. 5
FIG. 6
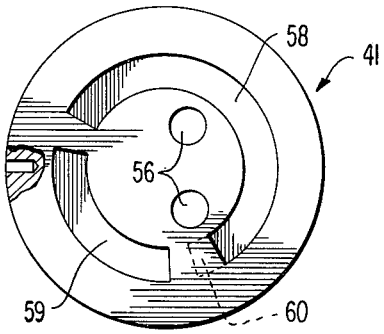
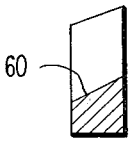
FIG. 6a

ELECTRIC IGNITION DEVICE

The present invention relates to an electric fuze, especially for hand grenades, having an electric energy source which is activated upon application of a force, and having an electric delay unit for delaying the detonation of a primer element with respect to the activation of the energy source, the delay unit including an RC member providing a variable time constant.

In hand grenades, as well as in other explosive devices, it is improtant that the disintegration take place with a time delay as compared to the triggering, because the explosive body must first be propelled or fired out of the danger zone. In hand grenades, this delay is conventionally accomplished by mechanical delay primers operated by a spring or by pyrotechnical primers operating with burning lines, fusible elements, or the like. The mechanical delay units have the disadvantages that they are dependent on temperature and are susceptible to aging. Additionally, pyrotechnical delay and igniting devices occupy a relatively large amount of space, which is undesirable particularly in smaller explosive devices, such as hand grenades. Moreover, in case of pyrotechnical delay devices, there is the possibility that undetected flaws exist in the pyrotechnical burning line, produced by faulty compression of the deflagrating charge and resulting in rapid burn-through. This can cause considerable dangers and a safe functional control during the mass production of such delay devices cannot be accomplished at tolerable expense.

It is furthermore known, according to DOS [German Unexamined Laid-Open Application] 1,933,377, to provide electric fuzes with an electric delay member with an RC mamber, a trigger or threshold value switch, and a circuit breaker. The electric voltage built up at the RC member with a time delay after application of the ignition voltage ignites, after exceeding the switching threshold voltage of the trigger switch such that the thyristor used as the circuit breaker then connects the ignition voltage to the primer element. These electronic delay members have a very small structural size and can be reliably tested as to their flawless functioning.

It is furthermore known to change the time delay in electric delay members in order to adapt to the respective requirements in an individual case, by changing the time constant of the RC member. For this purpose, the resistor of the RC member can be constructed, for example, as a potentiometer, so that the magnitude of the resistance and thus also the delay period of the finished delay unit can be constantly changed. However, instead, it is also possible to provide several resistors which are added or disconnected by means of mechanical switches in correspondence with the delay time required in a certain case; this makes it possible to change the delay time stepwise. Apart from the fact that electric fuzes with these delay members with variable delay time again occupy a relatively large amount of space due to the mechanical switching elements, which is often unavailable in smaller explosive devices, these fuzes are also sensitive to environmental influences due to the electric contacts in the potentiometer and/or in the mechanical switches, so that the required functional safety cannot be ensured.

The present invention is based on the problem of avoiding the aforementioned disadvantages in an electric fuze, especially for hand grenades, wherein an electric energy source is activatable upon the application of force and having an electric delay unit with an RC member which delays the detonation of a primer element with respect to the activation of the energy source, the RC member having a variable time constant.

It is thus an object of the present invention to provide a fuze which overcomes the disadvantages of prior art arrangements.

It is another object of the present invention to construct the fuze so that it functions flawlessly even under unfavorable environmental conditions, and simultaneously has a maximally compact construction and can be manufactured with low expense.

In order to solve the problem, the invention provides a fuze wherein the RC member has several resistors and/or capacitors, arranged in a series and/or a parallel connection, which components are functionally connected with one another by electric lines. The electric lines, for the purpose of effecting predetermined variations of the delay time, are arranged to be open circuited or interrupted by severing of shearing of the lines. This avoids advantageously any contacts of contact points in the RC member, and the functional deviations due to changes of the contacts are eliminated. Depending on the arrangement of the electric lines, the severing or interruption thereof causes the resistors and/or capacitors to be connected into the circuit or to be eliminated from the circuit. Thus, in case the resistors or capacitors are connected in parallel, a more or less large number thereof can be cut out by interrupting the electric lines connecting same, in dependence on between which resistors or capacitors the severing is effected. In this context, a change in capacitance has a stronger effect than a corresponding change in resistance.

With a view toward a minimum manufacturing cost, an embodiment of the present invention provides that the RC member has a base resistor and at least one secondary or supplementary resistor connected in series therewith, wherein the at least one secondary resistor is inherently short-circuited by an electric line. Due to the interruption of the electric line bridging the at least one secondary resistor, the secondary resistor is electrically connected with the base resistor and the delay time is correspondingly lengthened. Further extensions of the delay time are possible by the insertion of a second, third, etc. secondary resistor. Of course, if this should be advantageous from a manufacturing viewpoint, the base resistor can also be inherently short-circuited by means of a corresponding electric line, which must then, however, be severed in any event prior to triggering the primer element, in order to obtain the basic delay before the corresponding short-circuiting lines of the individual secondary resistors are selectively interrupted. However, basically, it is also possible to connect in series additional capacitors which are short-circuited by means of the electric lines, if this should prove advisable in an individual case, instead of the resistors.

The severing of the electric lines can be accomplished, for example, with the aid of a cutting blade arranged in the primer housing, which is actuated directly from the outside and can be correspondingly displaced. However, in order to effect a rapid and secure setting of the respective delay period even under adverse conditions, e.g., under extreme cold, a feature of the present invention provides that the RC member is accommodated in a bipartite housing and the electric lines are severed by twisting and/or shifting the two parts of the housing with respect to each other. Accordingly to another feature of this invention, the provision is made furthermore that the two parts of the housing can be fixed, by means of resilient locking or detent elements, in predetermined mutual rotary-angle or displacement positions. This, on the one hand, considerably reduces the danger of an unintended shifting during the handling of the explosive device with the fuze installed therein, and, on the other hand, the intended setting can be effected also during darkness because the locking of the catch can be heard clearly.

According to another feature of the invention, the electric lines are provided with a loop-shaped section which can be sheared off by twisting and/or shifting one of the housing parts. As compared to the simple severing of a straight electric line, for example, the advantage is thereby attained that, after the shearing off of the loop-shaped section, the two ends of the electric line are clearly separated in space and thus also electrically. Consequently, no special auxiliary means are required to prevent the re-establishment of the electric contact between the ends of the interrupted electric line.

A particularly compact structure which is safe in handling and functioning is achieved for the fuze of this invention if, according to a further feature of the invention, the two parts of the housing are fashioned to be two connectible, mutually rotatable tubes, one of which tubes contains the energy source, the delay section, and the primer element and the other of which tubes has a dividing disk connected for rotation with the tube, which disk closes off the first tube at its end with the delay section and carries on its side facing this end a groove of the shape of a circular segment. The loop-shaped sections of the electric lines extend into this groove and can be sheared off on a shearing edge formed at one end of the groove.

In order to avoid, in a dividing disk made of an electrically conductive material, an electrically conductive connection between the two ends of the sheared-off electric line by way of the dividing disk, the dividing disk is provided, according to this invention, with another groove of the shape of a circular segment on the side facing the first tube. The ends of the originally loop-shaped sections, which extend freely into space after the shearing step, project into this groove without electric contact with the dividing disk and with each other. This additional groove can also be fashioned as a continuation of the first groove, for example in case there is no danger that the sheared-off, loop-shaped sections, which move to and fro uncontrollably within the first groove, establish a renewed electric contact of the two ends of the interrupted electric lines.

In many cases, there is the requirement that, in case of an unintended activation of the energy source and an ensuing detonation of the primer element, the transmission charge, i.e., the booster, connected thereafter must not be ignited. For this purpose, the present invention has the additional feature that the dividing disk is simultaneously designed as a mechanical detonator protection between an eccentrically arranged primer element and the booster, by providing the dividing disk with at least two eccentrically located bores associated with the primer element in the predetermined rotary-angle positions. Whether the bores are fashioned to be continuous or blind bores depends on the conditions of each individual case. In any event, the construction is chosen so that, in the saftey position of the fuze, no transmission of the detonation from the primer element to the booster is possible. This also holds true for the possible continuous construction of the circular-segment-shaped groove and/or grooves. In case of bores which are not continuous, these bores start preferably from the side of the dividing disk facing the primer element. If also the groove or grooves are fashioned to be noncontinuous, the side of the dividing disk facing the booster is completely closed, so that the booster charge can optionally be introduced by pressing it directly against the dividing disk into the primer housing.

These and further objects, features and advantages of the present invention will become more obvious from the following description when taken in connection with the accompanying drawings which show, for purposes of illustration only, several embodiments in accordance with the present invention, and wherein:

FIG. 1 shows, in principle, the structural configuration of a hand grenade with the fuze inserted therein, FIG. 2 shows the electric circuit diagram of the fuze of the present invention for utilization in a hand grenade according to FIG. 1, FIG. 3 shows an equivalent circuit diagram of the threshold value switch utilized in the circuit of FIG. 2, FIG. 4 shows an arrangement in accordance with the present invention for dividing the resistance of a delay circuit to obtain selectively settable delay periods, FIG. 5 shows a longitudinal sectional view of the construction of a hand grenade primer, including a dividing disk, FIG. 6 shows a top view of the dividing disk illustrated in FIG. 5, and FIG. *6a* shows a knife edge portion of the dividing disk.

Referring now to the drawings wherein like reference numerals are utilized to designate like parts, there is shown in FIG. 1, a piezoelectric hand grenade fuze 10 forming a separate component which is threadedly inserted in a hand grenade housing 11 containing a bursting charge. The fuze includes a safety lever 12, which after being triggered causes a striker 14 pretensioned by a spring 13 to execute a rotation about its pivot axle 15 and strike an anvil 16. A piezoelectric element 17 is disposed below the anvil 16 and is embedded in a counter holder 18 which piezoelectric element is elastically deformed by the percussion. The electric charge generated in the piezoelectric element 17 by this force effect is further transmitted to a primer 20 via the delay unit 19. In place of a piezoelectric element as the source of electric energy it is, however, possible to employ, for example, also an electric battery which applies an output to the delay unit 19, for example, only at the instant of activation by the safety lever 12 or the like. The primer element 20 is constructed, for example, in accordance with DOS 2,020,016 as a metal-coated primer which is inserted in a downwardly open bore 21 of the primer housing and effects, when triggered, the detonation of the bursting charge housed in the grenade shell 11. The anvil 16, the piezoelectric element 17, the counter holder 18, the delay unit 19, as well as the primer element 20 are arranged coaxially in series within the primer housing in close adjacency.

FIG. 2 shows the electric circuit for the fuze illustrated in FIG. 1. The piezoelectric element 17 is connected with a storage circuit, comprising for example a diode 22 and a storage capacitor 23. A Zener diode 24 is connected in parallel with the storage capacitor 23 for purposes of voltage stabilization. This has the effect that the delay circuit is operated at a defined voltage, independently of the force of the mechanical impulse effective on the piezoelectric element 17, so that the thus-produced delay is independent of the strength of the striker impulse, which is subject to fluctuations due to deviations in tolerances of the mass-produced springs 13. The charge of the storage capacitor 23 is transmitted to the RC member, consisting of a resistor 25 and a capacitor 26 connected in series therewith. At the junction 27, the RC member is connected to the control input of a threshold value switch 28, the load line of which, also including the primer element 20, is likewise connected in parallel to the storage capacitor 23.

The mode of operation of the circuit is as follows: When the striker 14 (FIG. 1) strikes the anvil 16, an electric output is generated at the piezoelectric element 17 and this output is stored via the diode 22 at the storage capacitor 23. The voltage at the capacitor 23 is stabilized to a constant value by means of the Zener diode 24. The stabilized voltage is applied to the RC member 25, 26. In accordance with the time constant thereof, a voltage is built up with a time delay at 27 and after the threshold value of the trigger 28 has been reached, the latter is connected into the circuit, so that the load line becomes low-ohmic and the line 30 is connected to the primer element 20. The primer element is thereby ignited and initiates the detonation of the grenade. The circuit illustrated in FIG. 2 can be tested with respect to its function and optionally adjusted accordingly. This circuit can be accommodated in a minimum amount of space in the primer housing and can optionally also consist of one or several pluggable modules which are inserted in the primer housing or plugged together.

FIG. 3 shows, for a more detailed explanation, the equivalent circuit diagram of a construction of the threshold value switch 28, which is normally fashioned as an integrated component.

The anode-cathode path (load line) 30, 31 is represented by a thyristor 32 in series with a diode 33. A diode 34, operated in the blocking direction, is connected to the control electrode of the thyristor 32. When the natural breakdown voltage, lying between 6.8 and 7.1 volts, is exceeded, the diode 34 becomes conductive and actuates the thyristor 32. The diode 33 serves to protect against the so-called overhead or undesired ignition which occurs when there are very steep voltage rise conditions between the anode and cathode.

In FIG. 4, an embodiment of the delay unit is illustrated, wherein the base resistor 25*a* and the three secondary or supplementary resistors 25*b*, 25*c* and 25*d* are connected in series. The secondary resistors are inherently short-circuited by means of electric lines 35 having loop-shaped sections 36.

A fuze construction in accordance with the present invention is shown in FIGS. 5 and 6. For reasons of clarity, the safety lever, the striker, as well as the striker-tensioning spring have been omitted. The fuze has a bipartite housing 37. The lower housing portion 38 is a tube member provided with a flange 39 at the upper end and threadedly inserted in the hand grenade housing with an external thread 40 provided below the flange. From below, a dividing disk 41 is inserted in the tube 38 and fixedly joined with the latter by means of a radially extending pin 42. The dividing disk 41 will be described in greater detail below. The second, upper housing portion 43 is also a tube member which is inserted along part of its length in the tube 38 and is rotatable therein. The two tubes 38, 43 are axially nondisplaceable with respect to each other. For this purpose, a clamping ring 44 is provided which engages in radial grooves 45, superimposed in congruent relationship on both tubes 38, 43. The clamping ring 44 is disposed below the thread 40 and thus is, in the assembled condition, in the interior of the hand grenade housing.

Above the flange 39 of the lower tube 38, the upper tube 43 is widened in its diameter. The thereby formed annular flange has at least one bore 29 extending in the axial direction which, in specific rotary-angular positions of the tubes 38, 43, confronts respectively one corresponding identation 46 on the topside of the flange 39. A compressible plug 47 of, for example, silicone rubber, as well as a ball 48 are inserted in the bore 29. In place of the plug, it would, of course, also be possible to insert a coil spring which, however, would be more expensive. Also, in place of the ball, a cylindrical pin with a correspondingly curved front surface could also be employed, for example. The ball 48 is pressed, by the elastically compressed plug 47, into the respective indentation 46, so that, when the at least one bore 29 is congruent with one of the indentations 46, a ball catch is obtained which defines specific rotary-angular positions. In order to mark the respective rotary-angular position, corresponding markings 49 are provided at both tubes 38, 43. In the zone of the abutting surfaces of the two annular flanges of tubes 38, 43, a stop member is furthermore provided so that the two tubes 38, 43 can be turned, out of their initial position, only in one direction with respect to each other. Optionally, an additional mechanical stopping member can be included, so that the tubes 38, 43, for example, cannot be turned from the third rotary-angle position back into the second position, to avoid any errors in the actually set delay time.

The tube 43 is covered at its top portion by means of a screw cap 50. a metallic striker pin 51 is housed in an axial bore of the screw cap 50 which striker pin is effective on a housing 52 disposed in the interior of the tube 43. The housing accommodates schematically illustrated electric energy source 53 having two contacts 54 leading downwardly into the bore 55 of the tube 43, where the schematically illustrated electric delay unit 19 and the primer element 20 are housed. The primer element 20 is constructed as a cylindrical part eccentrically mounted in the bore 55 and sliding over the dividing disk 41 fixedly joined to the tube 38 when the tube 43 is rotated.

The dividing disk 41 is shown in a top plan view in FIG. 6. The disk has eccentric bores 56 at two places which bores are disposed underneath the primer element 20 in predetermined rotary-angular positions of the tubes 38, 43 and make it possible for the ignition to proceed from the primer element 20 to the booster charge 57 arranged underneath the dividing disk 41. The disk is furthermore provided with a groove 58 having the shape of a circular segment, for receiving the loop-shaped sections 36 of the electric lines 35, as well as with the additional groove 59, also having the shape of a circular segment, to receive the ends of the lines 35 after they have been sheared off. The dividing disk 41 thus ensures, on the one hand, the mechanical safety against misfirings, by making it possible to detonate the bursting charge only in specific angular positions of the two tubes 38 and 43 and, on the other hand, contains a shearingoff mechanism for the electric lines 35 of the resistors 25 of the delay unit 19.

The electric lines 35 are laid within the delay unit 19 so that they extend with their loop-shaped sections 36 downwardly into the groove 58 of the dividing disk 41. The end 60 (FIGS. 6 and 6*a*) of the groove 58 is fashioned as a knife which has a radial shearing edge on the side of the dividing disk 41 facing the primer element 20. This knife shears off the wire loops 36 extending into the groove 58 in succession when the tube 43 is rotated. The corresponding resistors 25*b*–25*d* are thus freed of their short-circuit lines or leads so that their values are added to those of the resistor 25*a* and the delay time is correspondingly lengthened. The electric lines 35 are preferably made in the form of a wire of an electrially conductive material, which can readily be cut off, such as brass, for example.

The markings 49 on the outside of the tubes 38, 43 indicate when one of the wire loops 36 is opened by shearing it off, and contain advantageously in writing the associated delay time. In this way, by turning the tube 43, a chronological staggering of the detonation delay can be achieved. The entire structure can be kept extremely compact with for example, a housing of the type shown in FIG. 5 having a length of 40 mm. and a maximum diameter of 20 mm.

Obviously, many modifications and variations of the present invention are possible in the light of the above teachings. It should therefore be understood that within the scope of the appended claims, the invention may be practiced otherwise than as specifically described.

We claim:

1. An electric fuze, especially for hand grenades, comprising power source means responsive to a force effect for supplying power output, delay unit means responsive to the power output of said power source means for providing an output for igniting a primer at a time period delayed with respect to the time of supply of power output by said power source means, said delay unit means being an RC circuit means having a variable delay period and including at least a plurality of one of resistors and capacitors connected in one of a series and parallel connection, said plurality of one of resistors and capacitors being electrically connected together by electricl leads disposed to be open-circuited so as to interrupt the electrical connection therethrough for changing the delay period of said delay unit means in a predetermined manner, and means for severing at least one of said electrical leads so as to provide an open circuit thereof thereby changing the delay period.

2. A fuze, according to claim 1, wherein said electrical leads are connected for short-circuiting a respective one of said plurality of one of resistors and capacitors.

3. A fuze, according to claim 1, wherein said RC circuit means comprises a first resistor and at least one secondary resistor connected in series therewith, said at least one secondary resistor being inherently short-circuited by said electrical lead associated therewith.

4. A fuze, according to claim 3, further comprising bipartite housing means for accommodating said RC circuit means therein, said housing means having two parts movable with respect to each other for open-circuiting said electrical leads associated with said at least one secondary resistor.

5. A fuze, according to claim 4, wherein said bipartite housing means includes resilient locking means for mutually locking said two housing parts in predetermined displacement positions with respect to one another.

6. A fuze, according to claim 5, wherein said resilient locking means mutually locks the two housing parts into displacement positions which are rotary-angular positions with respect to one another.

7. A fuze, according to claim 6, wherein said electrical leads are provided with loop-shaped sections, said loop-shaped sections being arranged for severence from the other portion of said electrical leads by the displacement of the two housing parts with respect to one another.

8. A fuze, according to claim 7, wherein said two housing parts are constructed as first and second mutually rotatable tubes, one of the first and second tubes being insertable within the other of the first and second tubes, said first tube having said power source means, said delay unit means and said primer contained therein, and said second tube having a dividing disk member connected for rotation therewith, said disk member closing off the end of said first tube at which the delay unit means is disposed and being provided on the side facing said first tube with a first groove in the shape of a circular segment, said loop-shaped sections of said electrical leads extending into said first groove, said dividing disk being provided with means for severing said loop-shaped sections.

9. A fuze, according to claim 8, wherein said means for severing includes a shearing edge member provided at one end of said first groove.

10. A fuze, according to claim 9, wherein said dividing disk member is provided with a second groove in the shape of a circular segment on the side thereof facing said first tube, said second groove being arranged for receiving the free ends of said electrical leads after severing of said loop-shaped sections from said electrical leads so that the free ends extend without electrical contact with said dividing disk member and with one another.

11. A fuze, according to claim 8, wherein said dividing disk member separates said primer which is eccentrically disposed in said first tube on one side of said disk member and a booster charge disposed on the other side of said disk member, said dividing disk member being provided with at least two eccentrically arranged bores for providing communication between said primer and said booster charge in predetermined rotary-angular positons of said bipartite housing means whereby said dividing disk member serves as a detonation safety member.

12. An electric fuze, especially for hand grenades, comprising power source means responsive to a force effect for supplying power output, delay unit means responsive to the power output of said power source means for providing an output for igniting a primer at a time period delayed with respect to the time of supply of power output by said power source means, said delay unit means being an RC circuit means having a variable delay period and including at least a plurality of one of resistors and capactiors connected in one of a series and parallal connection, said plurality of one of resistors and capacitors being elecrically connected together by electrical leads disposed to be open-circuited so as to interrupt the electrical connection therethrough for changing the delay period of said delay unit means in a predetermined manner, and bipartite housing means for accommodating said RC circuit means therein, said housing means having two parts movable with respect to each other for open circuiting electrical leads associated with respective ones of said plurality of one of resistors and capacitors.

13. A fuze, according to claim 12, wherein said bipartite housing means includes resilient locking means for mutually locking said two housing parts in predetermined displacement positions with respect to one another.

14. A fuze, according to claim 13, wherein said resilient locking means mutually locks the two housing parts into displacement positions which are rotary-angular positions with respect to one another.

15. A fuze, according to claim 12, wherein said electrical leads are provided with loop-shaped sections, said loop-shaped sections being arranged for severence from the other portion of said electrical leads by the displacement of the two housing parts with respect to one another.

16. A fuze, according to claim 15, wherein said two housing parts are constructed as first and second mutually rotatable tubes, one of the first and second tubes being insertable within the other of the first and second tubes, said first tube having said power source means, said delay unit means and said primer contained therein, and said second tube having a dividing disk member connected for rotation therewith, said disk member closing off the end of said first tube at which the delay unit means is disposed and being provided on the side facing said first tube with a first groove in the shape of a circular segment, said loop-shaped sections of said electrical leads extending into said first groove, said dividing disk being provided with means for severing said loop-shaped sections.

17. A fuze, according to claim 16, wherein said means for severing includes a shearing edge member provided at one end of said first groove.

18. A fuze, according to claim 17, wherein said dividing disk member is provided with a second groove in the shape of a circular segment on the side thereof facing said first tube, said second groove being arranged for receiving the free ends of said electrical leads after severing of said loop-shaped sections from said electrical leads so that the free ends extend without electrical contact with said dividing disk member and with one another.

19. A fuze, according to claim 16, wherein said dividing disk member separates said primer which is eccentrically disposed in said first tube on one side of said disk member and a booster charge disposed on the other side of said disk member, said dividing disk member being provided with at least two eccentrically arranged bores for providing communication between said primer and said booster charge in predetermined rotary-angular positions of said bipartite housing means whereby said dividing disk member serves as a detonation safety member.

* * * * *